US011326429B2

(12) United States Patent
Alshmakhy

(10) Patent No.: US 11,326,429 B2
(45) Date of Patent: May 10, 2022

(54) METHOD AND DEVICE FOR PRODUCING FLUIDS OR GASES FROM A HORIZONTAL WELL

(71) Applicant: Abu Dhabi National Oil Company, Abu Dhabi (AE)

(72) Inventor: Ahmed Alshmakhy, Abu Dhabi (AE)

(73) Assignee: Abu Dhabi National Oil Company, Abu Dhabi (AE)

( * ) Notice: Subject to any disclaimer, the term of this patent is extended or adjusted under 35 U.S.C. 154(b) by 0 days.

(21) Appl. No.: 16/755,614

(22) PCT Filed: Nov. 10, 2017

(86) PCT No.: PCT/IB2017/057035

§ 371 (c)(1),
(2) Date: Apr. 13, 2020

(87) PCT Pub. No.: WO2019/073289

PCT Pub. Date: Apr. 18, 2019

(65) Prior Publication Data

US 2020/0332632 A1 Oct. 22, 2020

(30) Foreign Application Priority Data

Oct. 13, 2017 (WO) ..... PCT/IB2017/056352

(51) Int. Cl.
*E21B 43/14* (2006.01)
*E21B 33/12* (2006.01)
(Continued)

(52) U.S. Cl.
CPC ..... *E21B 43/14* (2013.01); *E21B 33/12* (2013.01); *E21B 33/14* (2013.01); *E21B 43/116* (2013.01); *E21B 43/168* (2013.01); *E21B 43/32* (2013.01)

(58) Field of Classification Search
CPC ..... E21B 43/14; E21B 33/12; E21B 33/14; E21B 43/116; E21B 43/168; E21B 43/32
See application file for complete search history.

(56) References Cited

U.S. PATENT DOCUMENTS 2,605,637 A * 8/1952 Rhoades ..... E21B 47/047 73/152.55
3,039,535 A * 6/1962 Hathorn ..... E21B 43/14 166/228

(Continued)

OTHER PUBLICATIONS

International Search Report and Written Opinion for corresponding Patent Application No. PCT/IB2017/057035 dated Mar. 20, 2018.

(Continued)

*Primary Examiner* — Michael R Wills, III
(74) *Attorney, Agent, or Firm* — Renner, Otto, Boisselle & Sklar, LLP

(57) ABSTRACT

The present invention relates to a method for producing fluids or gases from a horizontal well 10, the method comprising the steps providing a horizontal well 10 having a horizontal production openhole 20, dividing the horizontal production openhole 20 into at least two separate compartments 30, 32 by means of blockers 40, 42, providing for each separate compartment 30, 32 at least one production string 50, 52, and passing fluid or gas 100, 102 from each compartment 30, 32 to the surface 106 via the corresponding production strings 50, 52. The present invention further relates to a fluid or gas production device 1 for horizontal fluid or gas wells.

15 Claims, 4 Drawing Sheets

Figure 1:
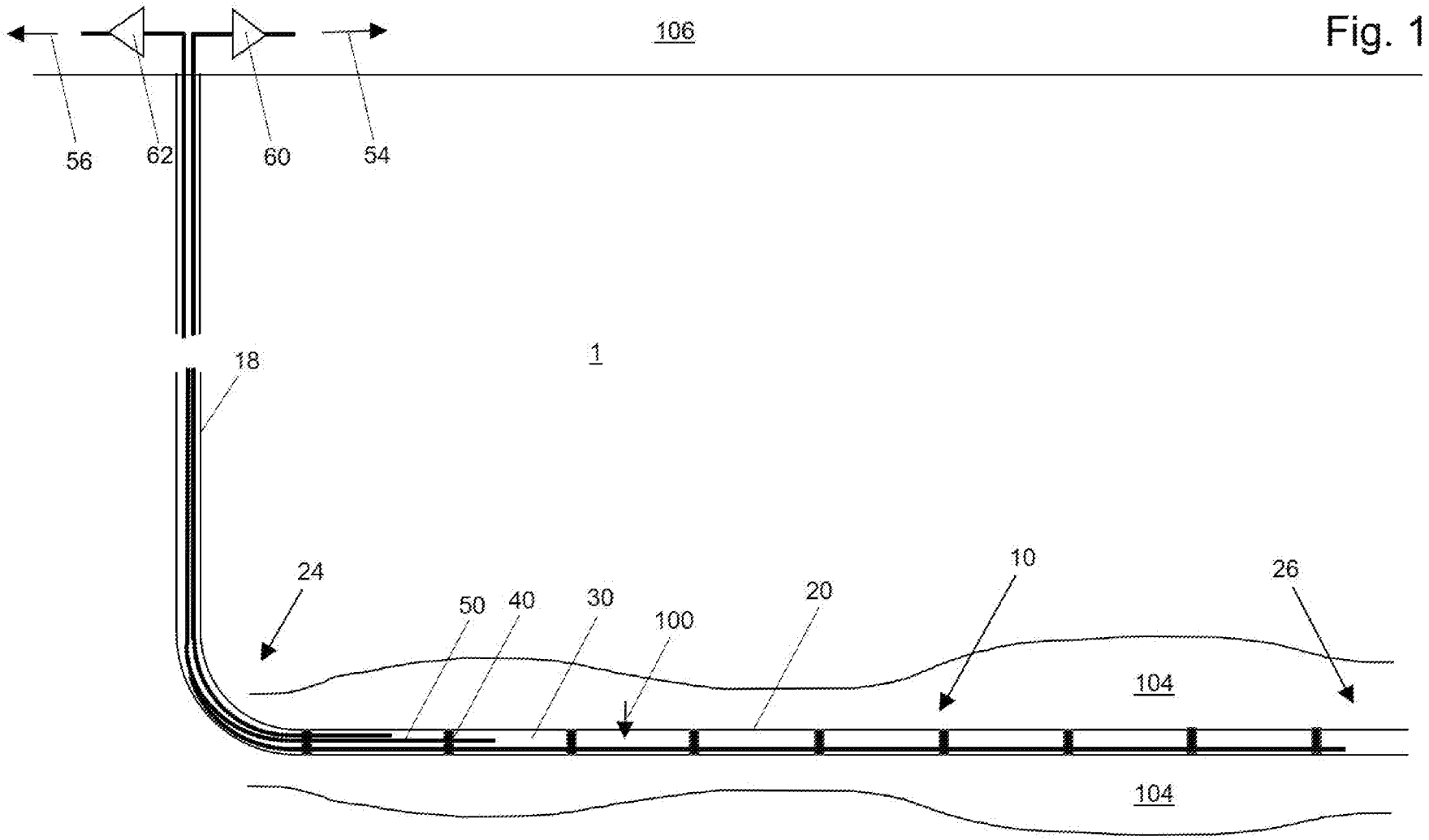

(51) Int. Cl.

| | |
|---|---|
| ***E21B 33/14*** | (2006.01) |
| ***E21B 43/116*** | (2006.01) |
| ***E21B 43/16*** | (2006.01) |
| ***E21B 43/32*** | (2006.01) |

(56) References Cited

U.S. PATENT DOCUMENTS 3,912,008 A * 10/1975 Crowe ..... E21B 34/14 166/212
4,942,926 A 7/1990 Lessi et al.
5,117,906 A * 6/1992 Giusti, Jr. ..... E21B 33/122 166/120
5,123,485 A * 6/1992 Vasicek ..... E21B 43/24 166/267
5,127,457 A * 7/1992 Stewart ..... E21B 43/305 166/306
5,862,863 A 1/1999 Swisher
6,073,696 A * 6/2000 Ellis ..... E21B 17/18 166/222
2003/0024704 A1* 2/2003 Hirsch ..... E21B 17/003 166/313
2012/0241168 A1 9/2012 Pei et al.
2013/0186618 A1 7/2013 Khisamov et al.
2015/0129201 A1* 5/2015 Winestock ..... E21B 41/0035 166/245
2015/0275645 A1* 10/2015 Gill ..... E21B 41/0042 166/303
2015/0369023 A1 12/2015 MacPhail et al.
2016/0273315 A1 9/2016 Carvajal et al.

OTHER PUBLICATIONS

Supplementary European Search Report for corresponding EP Application No. 17928576.2, dated Jun. 23, 2021.

* cited by examiner

METHOD AND DEVICE FOR PRODUCING FLUIDS OR GASES FROM A HORIZONTAL WELL

1. FIELD OF THE INVENTION

The present invention relates to a method and a device for producing fluids or gases from a horizontal well.

2. TECHNICAL BACKGROUND

In modern economy oil and natural gas are of particular economical relevance. Large volumes are produced every year with an increasing demand. However, these fluids or gases are often embedded in formation layers below the earth's surface and are difficult to produce.

The documents U.S. Pat. Nos. 6,125,936, 5,335,732 and 5,816,326 each describe a method and an apparatus for producing oil or gas from vertical wells.

Besides the usage of vertical wells, also long horizontal wells are known in the art and have been drilled extensively in recent years. Thereby, at first a vertical well is drilled down to a certain depth and afterwards by means of a special drilling head a curved well—the so called "heel"—and finally a horizontal well is drilled until the so called "toe". Because of this technique it is possible to produce oil or gas also from formations in which the oil or gas volume essentially extends only in a vertically limited, narrow, horizontal region.

In order to stimulate the discharge of oil or gas from the formation in which the oil or gas is embedded, so called fracking techniques may be used. Thereby, after drilling the well and before oil or gas production is performed a special liquid, liquids or gases are introduced under high pressure into the formation, or formations, via the well. Other methods exist to enhance communication between formation and wellbore.

Horizontal well production was initially expected to exceed production of vertical wells due to a larger surface area of the formation penetrated by the horizontally extending production hole. A greater exposure to the formation through long production zones was believed to increase production linearly. However, in practice this was not the case, since a greater recovery was experienced at the heel of the production hole while less production took place at the toe.

In general, this "toe to heel" effect provides for a much stronger oil production at the heel of the horizontal well, i.e. where the horizontal well extends in a curved shape into the vertical well, than at the toe, i.e. the distal end of the horizontal well. The stronger oil production at the heel, however, leads to a higher risk of water coning in this region and at the same time reduces the production of oil or gas from the toe due to inefficient stimulation and/or high pressure drop when fluid moves from toe to heel. If due to a high production rate at a certain area of the well, water coning occurs, the oil or gas volume is locally exhausted and water is produced instead. Moreover, in case water coning occurs at the heel all further produced oil or gas in the whole production hole is contaminated with water. Because of this contamination the well becomes generally uneconomical and is, thus, abandoned even if there is still oil or gas in more distal toe areas of the well available.

Various techniques have been employed to drive production away from the heel in order to recover from the toe. The document US 2002/009 63 29 A1 describes a system for enhancing oil production in unconsolidated horizontal wells.

Thereby, the system wants to enable the well operator to create a uniform pressure drop, across production hole, from heel to toe of the horizontal well.

However, in particular in tight oil or gas reservoirs, several further challenges arise like increased development costs, a short well life, limited accessibility and an uneven stimulation, to name a few.

It is the problem of the present invention to provide a method and a device for producing fluids or gases from a horizontal well that comply with the above mentioned requirements and constraints.

3. SUMMARY OF THE INVENTION

At least one of the problems is solved by a method for producing fluids or gases from a horizontal well according to claim 1 and a device for producing fluids or gases from a horizontal well according to claim 9.

In particular, at least one of the problems is solved by a method for producing fluids or gases from a horizontal well, the method comprising the steps of providing a horizontal well having a horizontal production openhole, dividing the horizontal production openhole into at least two separate compartments by means of blockers, providing for each separate compartment at least one production string, and passing fluid or gas from each compartment to the surface via the corresponding production strings.

In standard well designs only a single production string is provided which is commonly located towards the heel of the horizontal production hole. However, this single production string only leaves one point for flow withdrawal and control. A lower intake pressure of the production tubing will result in an increased production at the heel, as already mentioned, but will not significantly affect the production at areas in direction to the toe of the production tubing.

In contrast to this, the present method enables, by means of the separate compartments and the separate production strings for each compartment of the horizontal well, the parallel production or flow of oil or gas from the overall horizontal production openhole. In general, this leads to a significantly reduced "toe to heel" effect. The production of each compartment is in principle independent of the production of the other compartments. Thus, the production rate for each compartment of the horizontal well can be controlled individually. This allows to manage or avoid water coning and increases the incremental production for each segment. Further, full toe accessibility of the horizontal well is provided, which increases the overall well productivity.

Thereby, the accessibility, in particular of longer horizontal wells, is increased. In each compartment production string an adequate intake pressure can be provided, e.g. by controlling the respective choke of this production string, irrespective of the location in the horizontal well. Furthermore, the application of individual production strings for each compartment leads to less congested areas and reduces the anti-collision risk and the overall well costs by reducing well count. Moreover, the present method provides future opportunities for optimizing production configurations of horizontal wells especially in tight formations and/or long horizontal drains.

Preferably, the method further comprises the step of controlling the production flow rate of fluid or gas of each compartment individually. Because of controlling each compartment individually multiple points for flow rate control are provided. Thus, the production can be adjusted individually for each compartment for example based on the geological conditions at or around each compartment. In formation areas with a large volume of oil or gas, a higher production flow rate can be adjusted than in regions with a small volume while keeping the overall oil or gas distribution in the formation uniformly. Similarly, the production flow rates can be adjusted with regard to the oil or gas permeability of the formation or formations.

Preferably, the step of controlling the production flow rate of each individual production string includes a simultaneous, or non-simultaneous, passing of fluid or gas from all compartments to the surface. Thereby, an increased production can be achieved, in particular the production can be increased compared to an original single completion well. Furthermore, deeper horizontal areas can be accessed by the present method. Thus, the method of the present invention leads to optimized costs and time savings.

Preferably, the step of controlling the production flow rate of each individual production string includes the step of adjusting the flow rates according to an estimated volume of fluid or gas in the formation, or formations, adjacent to the respective compartment. The oil or gas volume in the formation generates a (liquid) resistance against the water in the formations above and below which like to enter into the oil or gas formations. If oil or gas is discharged too fast or too much at a certain point of the well water coning occurs. In the present invention, however, a substantially uniform distribution of the whole fluid or gas volume in the formation along the horizontal production openhole can be achieved. This uniformly distributed oil or gas volume, in return, avoids or delays water coning along the horizontal production hole. Furthermore, by a steady and uniform discharge of oil or gas from the formation along the horizontal production openhole more oil or gas can be extracted from the formation, until substantially producible oil or gas is discharged from the formation and water will penetrate into the production openhole. Thus, the well is more economical.

Preferably, the step of controlling the production flow rate of each individual production string includes the step of adjusting the flow rates such that water coning is managed or avoided. The individual controlling enables the formation of oil or gas volumes comprising essentially the same size at/around each compartment. Further, if water enters into one compartment of the well and into the respective production string, production from this compartment and string can be stopped without effecting production from other compartments and respective strings. Thus, water coning is managed or avoided, in particular at compartments in formation regions with only small volumes of oil or gas. Because water coning is managed or avoided the produced oil or gas in the production tubing is not contaminated with water from formations above or below. The oil or gas can be further processed easily which makes the well more profitable.

Furthermore, because water coning is managed or avoided practically most oil or gas volume embedded in the formation along the horizontal production openhole can be produced by the method of the present invention. No well has to be abandoned ahead of time due to water coning. Thereby, the number of wells can be reduced and the surface foot print can be minimized.

All in all, the control of the production flow rate of each individual production string provides an overall control and management or avoidance of water coning that results in a lost well in particular when high permeability zones for water exist at the heel.

Preferably, the method further comprises the step of injecting an injection liquid, or gas, simultaneously, or non-simultaneously, into all compartments or into one compartment after the other according to a certain timely pattern, via corresponding injection strings of each compartment. Thereby, the injection of the injection liquid or gas under high pressure into the formation around the horizontal openhole stimulates, or enhances, the production of oil or gas from the formation. Because of this stimulation or fracking smaller oil or gas volumes agglomerate, discharge from the formation and can penetrate the horizontal production openhole. Preferably, the injection strings can be used as production strings.

Furthermore, the controlled injection into each compartment provides for an effective, uniform and better stimulation. Thereby, for each compartment the composition and/or pressure of the injection liquid or gas can be adapted according to the corresponding formation around the compartment in order to achieve a desired oil or gas output while utilizing the injection liquid or gas effectively. Thus, by using the present method also geological uncertainties can be addressed while injecting an adequate volume of injection liquid or gas. This allows locally adjustable fracking processes.

Preferably, the method further comprises the steps of inserting a metal tube into the horizontal well for providing an outer shell of the openhole, preferably cementing an area around the metal tube, and providing a porous structure in the metal tube, preferably by igniting an explosive charge inside the openhole of the horizontal well. The metal tube and the optional cement cylinder at the outer circumference of the well support the well and provide stability. Furthermore, the clean surface of the metal tube facilitates the arrangement of the production strings and blockers.

The explosion will generate fractures in the outer shell. These fractures form at least a part of the porous structure. In general, the porous structure is characterized by small holes through which oil or gas from the formation around the horizontal production openhole can penetrate into the production openhole, whereas formation particles are essentially prevented from getting into the production openhole. As a result, more or less pure oil or gas passes the production openhole to the surface. Thereby, clogging due to large formation particles in the production openhole is avoided.

Preferably, the step of controlling the production flow rate of fluid or gas of each compartment individually is done by means of at least one flow control device of at least one of the compartments, and/or at least one flow control device of at least one of the strings, and/or at least one sensor of at least one of the strings, and/or a downhole processor of at least one of the strings, and/or a communication capability of at least one of the strings, for communicating with a remote location.

At least one of the above-mentioned problems is also solved by a fluid or gas production device for horizontal fluid or gas wells, comprising a horizontal well having a production openhole, at least one blocker inside the production openhole for dividing the production openhole into individual compartments, and at least two individual production strings, of which at least one is extending inside the production openhole from the surface to one of the compartments with at least one production string individually for each compartment.

The at least one blocker divides the production openhole into individual compartments such that a production or production flow rate of one compartment does not affect the production of any other compartment. The horizontal production openhole is, thus, divided into several individual production areas. Thereby, a separate individual production string for each compartment, i.e. production area, enables the simultaneous, or non-simultaneous, production from multiple compartments while the production flow rate can be controlled for each compartment individually.

Preferably, each individual production string is connected to a choke, for individually controlling the production flow rate of fluid or gas for each compartment. In using a separate choke for each individual production string, the production flow rate can be controlled easily and individually. Thereby, the production flow rate can be adjusted continuously and timely according to actual needs.

Preferably, each blocker is impermeable for the fluid or gas and can be positioned freely along the length of the production openhole or casing. Thereby, the blockers are preferably swellable blockers. Because each blocker in the installed state is impermeable for the fluid or gas to be produced, it completely seals each compartment against the adjacent ones. Thus, a desired production flow rate due to a certain intake pressure of the production tubing only affects the specific compartment and not any other compartment. The free positioning allows for an arrangement of the blockers for example according to formation conditions along the horizontal production openhole.

Preferably, the individual production strings extend through the respective blocker or blockers and the respective blocker seals the pass of each production string against the fluid or gas. By sealing the pass of each production string directly by a blocker, no additional sealing elements are required and the isolation is facilitated.

Preferably, each individual production string can also be used as an injection string for injecting an injection liquid or gas from the surface to the corresponding compartment. The dual use of the production strings as injection strings for fracking and later as production strings saves space in the production openhole and costs and facilitates the overall fluid and gas production device. Furthermore, the individual injection of injection liquid or gas into each compartment provides for a controlled injection, e.g. with regards to applied pressure and/or volume of the injection liquid or gas. Thereby, different formation conditions at each compartment can be taken into account and an effective application of injection liquid or gas can be provided.

Preferably, the production openhole further comprises a permeable outer shell to allow the fluid or gas to penetrate from the formation, or formations, into the production openhole, wherein preferably the outer shell is made of a metal tube and preferably a cement layer, which have a porous structure. The metal tube and the optional cement cylinder at the outer circumference of the well support the well and provide stability. Furthermore, the clean surface of the metal tube facilitates the arrangement of the production strings and blockers.

Preferably, the production strings are made of a flexible and durable material, allowing to be bent from the vertical well to the horizontal production openhole and to endure high pressures of the fluid, gas and/or injection liquid, gas piped through. A flexible production string allows for a complete insertion of the whole string from the surface into the production openhole, without any connection steps or connection devices inside the well.

Preferably, the compartments include at least one flow control device. Preferably, the string includes at least one flow control device, and preferably the string includes at least one sensor. Furthermore, preferably, the string includes a downhole processor and preferably the string includes a communication capability for communicating with a remote location.

4. BRIEF DESCRIPTION OF THE DRAWINGS

Figure 2:
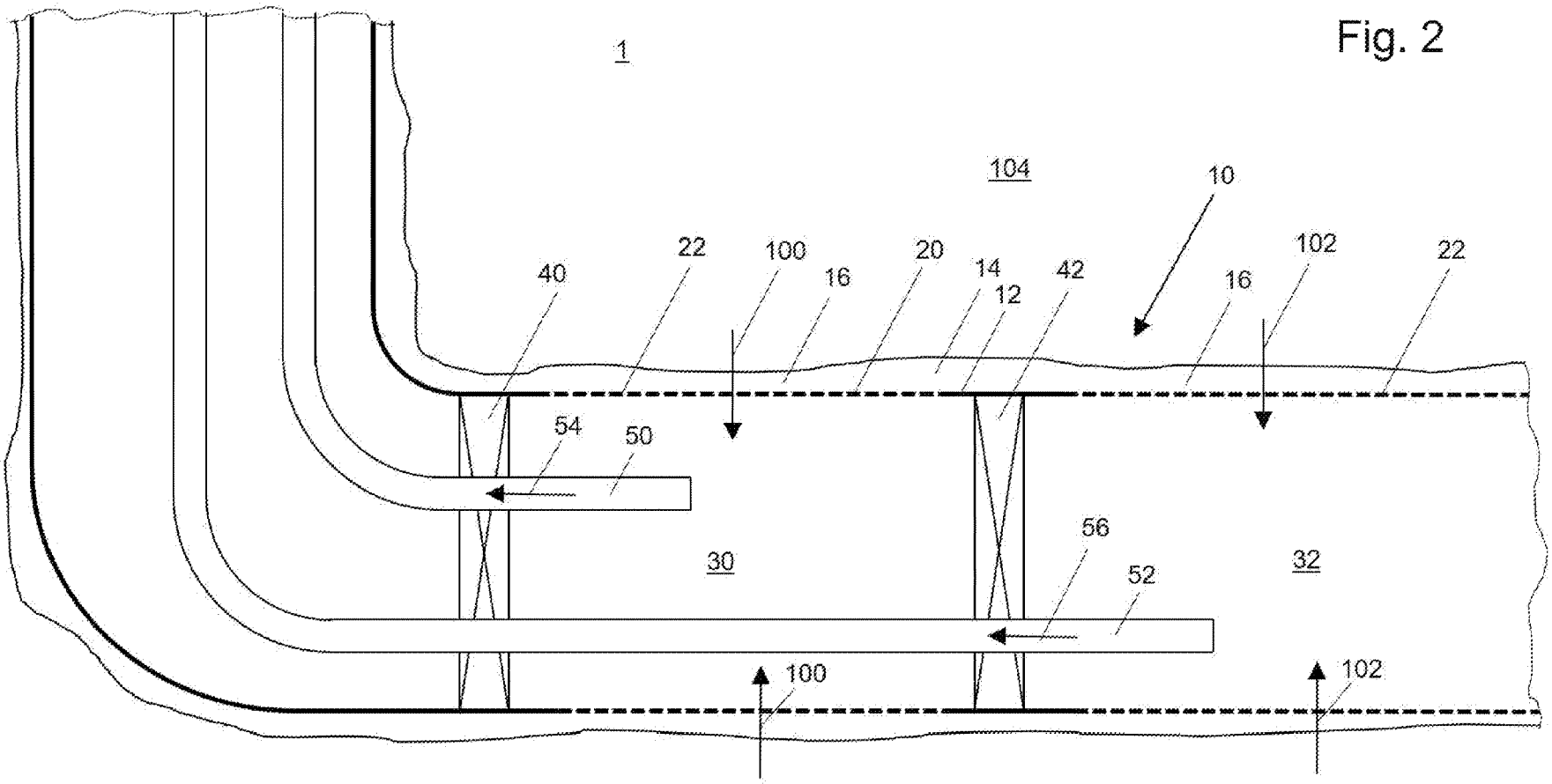
Figure 3:
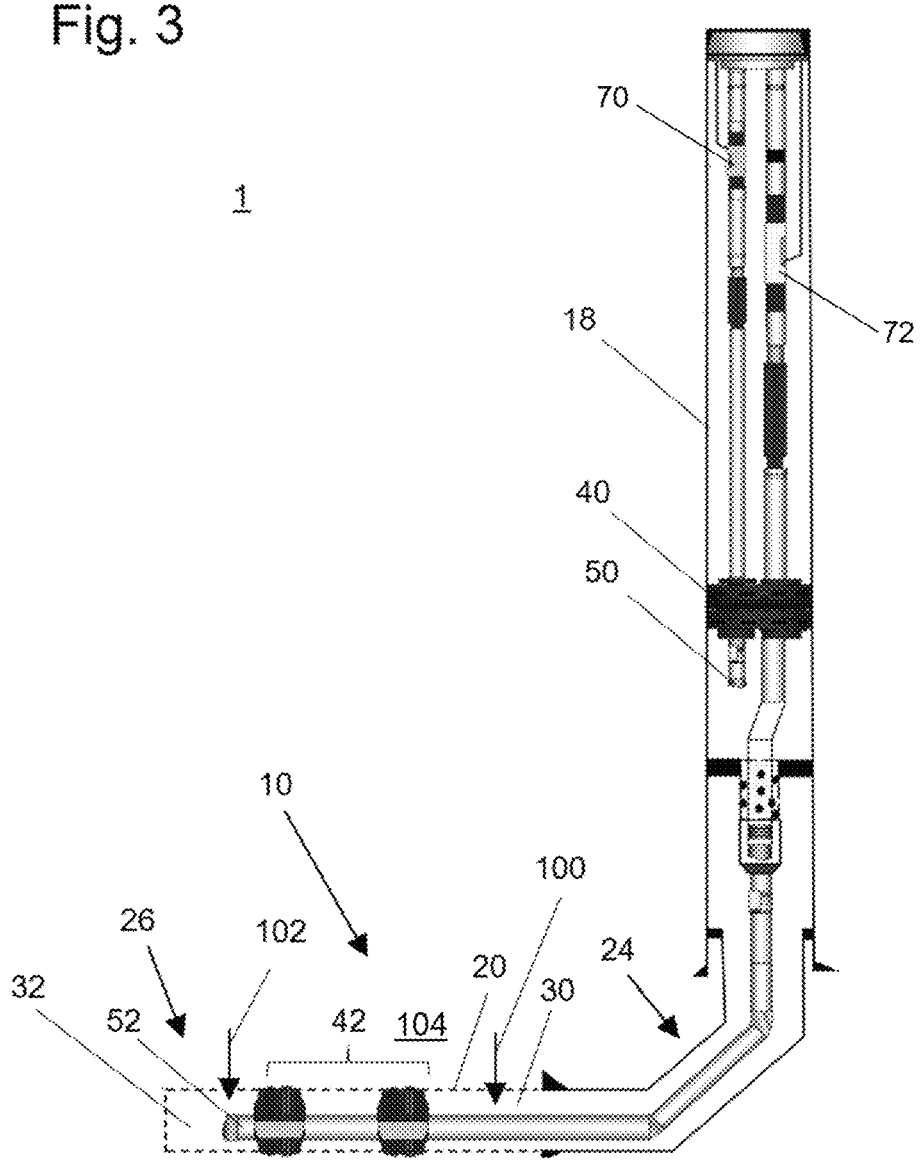
Figure 4:
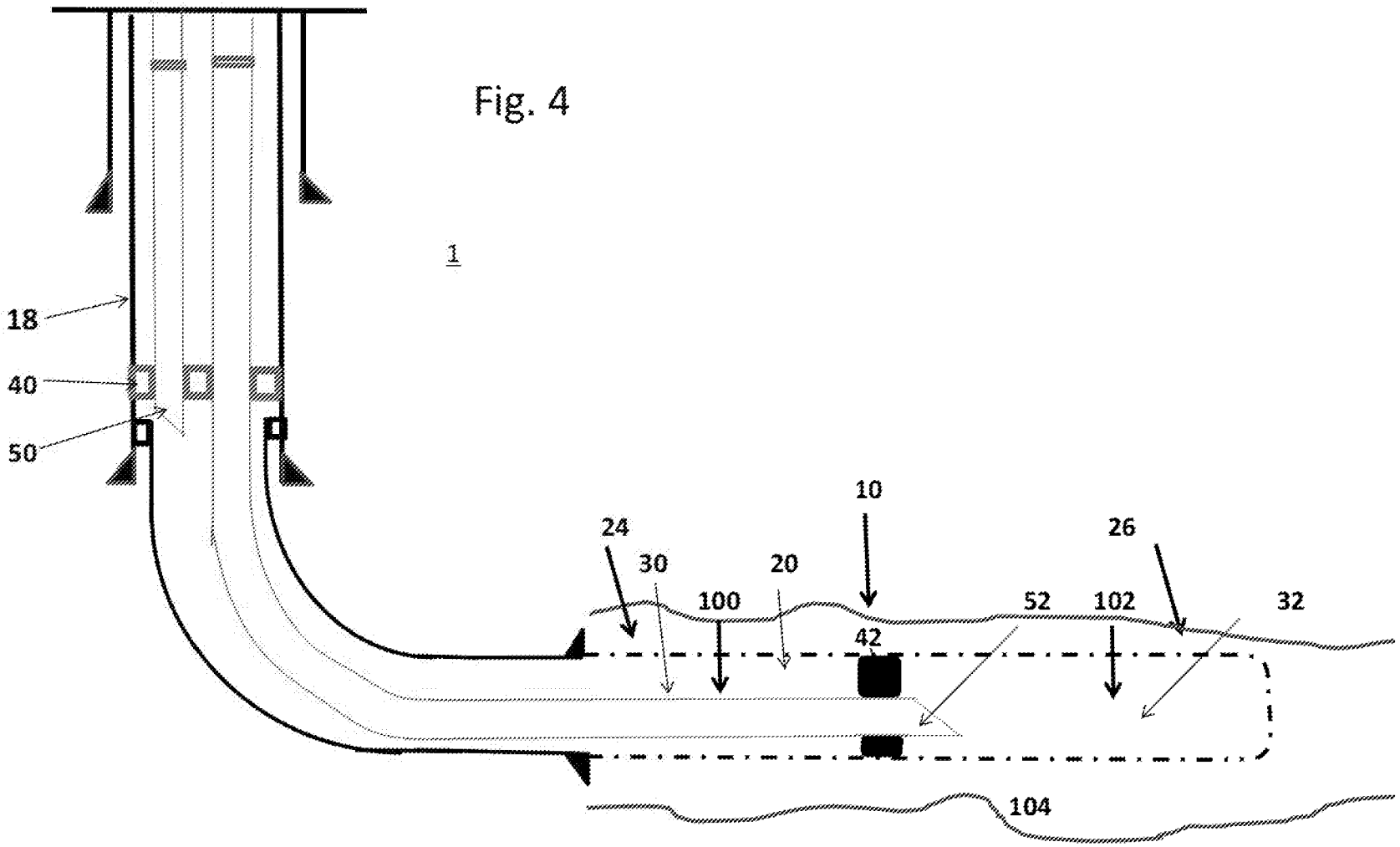

In the following, preferred embodiments of the invention are disclosed by reference to the accompanying figures, in which shows:

FIG. 1: a schematic cross-sectional view of a fluid or gas production device according to an embodiment of the present invention;

FIG. 2: a schematic cross-sectional view of an embodiment of the horizontal production well according to the present invention;

FIG. 3: a schematic cross-sectional view of a fluid or gas production device according to another embodiment of the present invention; and FIG. 4: a schematic cross-sectional view of a fluid or gas production device according to another embodiment of the present invention.

5. DETAILED DESCRIPTION OF EMBODIMENTS OF THE INVENTION

In the following, preferred embodiments of the invention are described in detail with respect to the figures.

FIG. 1 shows a schematic cross-sectional view of a fluid or gas production device 1 according to an embodiment of the present invention. Thereby, the region denoted by reference sign 106 represents the earth's surface and the region below surface 106 including formation, or formations, 104 is a subsurface region. This subsurface region comprises several different layers of formation (not explicitly shown), mainly extending in a horizontal direction, like oil or gas containing formation 104 in FIG. 1. Thus, formation 104 contains oil or gas 100, 102. In general, the oil or gas 100, 102 is available in the form of small droplets directly embedded in the structure of formation 104. Moreover, formation 104 may have a rather small vertical extension but a wide horizontal extension. Due to this, oil or gas 100, 102 production by means of a common vertical well 18 is less economical here and hence a horizontal well 10 is used in formation 104. It is to be noted that also more than one formation 104 may occur at an oil or gas 100, 102 production site. Different formation 104 layers containing oil or gas 100, 102 may be present at different depths.

Furthermore, a well is shown in FIG. 1 comprising a vertical well 18 and a horizontal well 10. Thereby, the vertical well 18 is drilled down by common drilling techniques to a depth above the formation 104 layer. Then, the vertical well 18 is extended in a curved way until it becomes a horizontal well 10. The transition zone between the curved path of the well or production openhole and the horizontal production openhole 20 is called "heel" 24. The distal end of the horizontal production openhole 20 is called "toe" 26. At the toe 24, the horizontal well 10 may be open to sediment 104. The course of horizontal well 10 does not need to be strictly horizontal in a mathematical way, but may provide some uphill slopes and descents. In an ideal case, the horizontal well 10 is arranged at a horizontal center line of formation 104 following its course in a horizontal direction. This would provide a uniform distribution of the oil or gas volume in formation 104 around the horizontal production openhole 20. In practice, however, the extend of formation 104 around the horizontal production openhole 20 differs along the length of the openhole leading to different distributions of oil or gas 100, 102.

In general, the diameter of the well 10, 18 is between 100 mm to 800 mm. The diameter of each production string 50, 52 is significantly smaller than the diameter of the production hole 20 such that one or multiple production strings 50, 52 can be inserted or arranged into one production openhole 20. Because FIG. 1 is a schematic drawing only, not all possible production strings are shown and only two production strings are shown extending to surface 106. In practice, however, every production string will extend from the horizontal production openhole 20 to surface 106 for individual oil or gas recovery. Each production string 50, 52 ends in one of the compartments 30, 32 and comprises an open end such that oil or gas 100, 102 discharged from formation 104 can enter a production string 50, 52 and flow to the surface. Thereby, the volume of oil or gas 100, 102 flowing through a production string 50, 52 can be given by the production flow rate 54, 56 that can be measured by commonly known measurement instruments on the surface 106, e.g. at chokes 60, 62. For the control of the production flow rate 54, the compartments may include at least one flow control device. Further, the production strings 50, 52 may include at least one flow control device. For example for measuring the flow rate, pressure or temperature of the oil or gas the strings 50, 52 may include a corresponding sensor (not shown). Furthermore, preferably, the strings 50, 52 may include a downhole processor 70, 72 and preferably the strings 50, 52 include a communication capability for communicating with a remote location, preferably at surface level. The controlling of the production flow rate 54, 56 can be performed by means of the mentioned chokes 60, 62, wherein each choke is connected to exactly one production string. The chokes 60, 62 are preferably arranged at the surface 106. For controlling purposes the operation of multiple or all chokes may be controlled by one choke controlling unit (not shown). Furthermore, it is possible to control the production flow rates 54, 56 by means of a pump or valve (not shown) or any appropriate means for controlling a fluid or gas flow in a pipeline. Thereby, the intake pressure of a production string 50, 52 can be generated by means of a pump or arises from the pressure of the oil or gas 100, 102 discharging from formation 104. The application of fracking techniques might increase the fluid or gas pressure in formation 104.

The produced oil or gas 100, 102 passing the choke 60, 62 of the respective production string 50, 52 is then passed via a pipeline to further production units for further processing (not shown).

FIG. 2 shows a schematic cross-sectional view of an embodiment of the horizontal production openhole 20 according to the present invention. Thereby, the horizontal production openhole 20 is positioned in formation 104 containing oil and/or gas 100, 102. The toe region is depicted on the right-hand side in FIG. 2 and the heel region is at the left hand side of FIG. 2, where the curved path of the production openhole connecting the vertical well 18 (upwards) and the horizontal well 10 is shown.

The outer circumference of the horizontal production openhole 20 may comprise a metal tube 12 and optionally a cement layer in an area 14 between the metal tube 12 and formation 104. Thereby, the metal tube 12 and the optional cement area 14 comprise a porous structure 16, i.e. they comprise fractures or small holes that enable oil or gas 100, 102 to penetrate into the horizontal production openhole 20. Thereby, metal tube 12 may already comprise such small holes or get these holes because of an intended explosion inside the horizontal production openhole 20. Furthermore, this explosion will generate small cracks or fractures in the optional cement area 14 such that it gets a porous structure 16 as well. The porous outer shell 22, comprising the perforated metal tube 12 and optionally the porous cement area 14, will prevent larger formation 104 particles from getting into the horizontal production openhole 20. The tubing may be initially slotted, e.g. a slotted liner, with no need for cementing or perforation.

Furthermore, the horizontal production openhole 20 is divided into compartments 30, 32 by means of fluid and/or gas impermeable blockers 40, 42. Along the horizontal production openhole 20 an arbitrary number of blockers 40, 42 can be arranged at equal or non-equal distances to each other. The positioning of the blockers 40, 42 may be performed for example according to formation 104 characteristics of the oil/gas 100, 102 volume in a region. These blockers 40, 42 also provide support for the production strings 50, 52 passing therethrough. The blockers are swellable and are made of an elastic material such that they seal each compartment in the fully swollen state at their outer circumference. Thus, they can be inserted into the production openhole easily in a dry state wherein they are smaller than the diameter of the openhole, and can be positioned simply by getting wet. Furthermore, due to their flexible mechanical properties they also seal the production strings 50, 52 extending therethrough.

Because of a lower pressure inside the horizontal production openhole 20 oil or gas 100 discharges from formation 104 into the production openhole 20 at compartment 30. Oil or gas 102 enters into compartment 32. Thereby, the lower pressure in production openhole 20 may be generated by a pump, preferably positioned at surface 106 or below surface, or due to a higher pressure on the oil or gas 100, 102 in formation 104 compared to the pressure in each compartment 30, 32 of horizontal production openhole 20. The oil or gas 100, 102 pressure in formation 104 may be increased by an application of fracking techniques. A higher oil or gas 100, 102 pressure may lead to higher production flow rates 54, 56 and may, thus, increase overall production efficiency.

All in all, a permanent discharge of oil or gas 100, 102 from formation 104 into horizontal production openhole 20 is possible. The production flow rate for each compartment 30, 32 can be individually controlled by corresponding individual chokes 60, 62 for each individual production string 50, 52. Of course, the production flow rate 54, 56 in one compartment 30, 32 can be decreased to zero, if needed, for example if water enters this compartment. Further, the production may be started or increased again at a later point in time by simply opening the choke 60, 62 again.

By individually controlling the production flow rate 54, 56 of each compartment 30, 32 an essentially even distributed oil or gas 100, 102 volume in formation 104 around the horizontal production openhole 20 can be achieved. Because of this even distribution of oil or gas 100, 102, no or delayed water coning occurs. Thus, in practice a large volume of oil or gas 100, 102 in formation 104 can be discharged into horizontal production openhole 20 before a significant amount of water will penetrate into the openhole 20 and the well has to be abandoned. This increases the productivity of a horizontal well significantly.

FIG. 3 shows a schematic cross-sectional view of a fluid or gas production device 1 according to another embodiment of the present invention. Therein, a first compartment 30 is formed in the production openhole 20 between a first blocker 40 and a second blocker 42. Each blocker may comprise multiple sections that further may be spaced apart to each other as can be seen for example at blocker 42. A second compartment 32 is formed between the toe 26 of the horizontal production openhole 20 and blocker 42. Oil or gas 100, 102 discharging from formation 104 can penetrate the horizontal production openhole 20 along the dotted line in FIG. 1. The oil or gas 100, 102 in each of the first or second compartment 30, 32 will then pass through the respective first or second production string 50, 52 to the surface. As can be seen in FIG. 3 the first production string 50 can also be arranged in the vertical well 18, however, nevertheless it will only get oil or gas 100, 102 from formation 104 in the horizontal production openhole 20. In conclusion, also with this embodiment of the present invention oil or gas 100, 102 can be produced simultaneously, or non-simultaneously, from both compartments 30, 32 in the horizontal production openhole 20. The long string 52 can be divided into multiple sections, preferably two or more sections. In FIG. 3, it is divided into two sections, a lower and an upper section. The lower section in this figure is equipped with a perforated joint to allow for gas or oil 100 to be produced from string 50.

FIG. 4 shows a schematic cross-sectional view of a fluid or gas production device 1 according to another embodiment of the present invention. Therein, a first compartment 30 is formed in the production openhole 20 between a first blocker 40 and a second blocker 42. Each blocker may comprise multiple sections that further may be spaced apart to each other. A second compartment 32 is formed between the toe 26 of the horizontal production openhole 20 and blocker 42. Oil or gas 100, 102 discharging from formation 104 can penetrate the horizontal production openhole 20 along the dotted line in FIG. 4. The oil or gas 100, 102 in each of the first or second compartment 30, 32 will then pass through the respective first or second production string 50, 52 to the surface. As can be seen in FIG. 4 the first production string 50 can also be arranged in the vertical well 18, however, nevertheless it will only get oil or gas 100, 102 from formation 104 in the horizontal production openhole 20. In conclusion, also with this embodiment of the present invention oil or gas 100, 102 can be produced simultaneously, or non-simultaneously, from both compartments 30, 32 in the horizontal production openhole 20.

LIST OF REFERENCE SIGNS

1 fluid or gas production device
10 horizontal well
12 metal tube
14 area around metal tube 12
16 porous structure
18 vertical well
20 production openhole
22 outer shell
24 heel
26 toe
30 first compartment
32 second compartment
40 first blocker
42 second blocker
50 first injection/production string
52 second injection/production string
54 first production flow rate
56 second production flow rate
60 first choke
62 second choke
100 oil/gas of compartment 30
102 oil/gas of compartment 32
104 formation
106 surface

The invention claimed is:

1. A method for producing fluids or gases from a horizontal well, the method comprising the steps:

(a) providing a horizontal well having a horizontal production openhole;
(b) dividing the horizontal production openhole into at least two separate compartments, by means of blockers;
(c) providing for each separate compartment at least one production string;
(d) passing fluid or gas from each compartment to the surface (106) via the corresponding production strings; and
(e) controlling a production flow rate of liquid or gas of each compartment individually, the controlling step including adjusting the flow rate according to an estimated volume of fluid or gas in a formation, or formations, adjacent to the respective compartment such that water coning is managed or avoided.

2. The method according to claim 1, wherein the step of controlling the production flow rate of each individual production string includes a simultaneous, or non-simultaneous, passing of fluid or gas from all compartments to the surface.

3. The method according to claim 1, further comprising the step of injecting an injection liquid, or gas, simultaneously, or non-simultaneously, into all compartments or into one compartment after the other according to a certain timely pattern, via corresponding injection strings of each compartment.

4. The method according to claim 1, further comprising the steps of:

inserting a metal tube into the horizontal well for providing an outer shell of the openhole;
cementing an area around the metal tube; and
providing a porous structure in the metal tube, preferably by igniting an explosive charge inside the openhole of the horizontal well.

5. The method according to claim 1, wherein said step of controlling the production flow rate of fluid or gas of each compartment individually is done by means of: at least one flow control device of at least one of the compartments; and/or at least one flow control device of at least one of the strings; and/or at least one sensor of at least one of the strings; and/or a downhole processor of at least one of the strings; and/or a communication capability of at least one of the strings, for communicating with a remote location.

6. A fluid or gas production device for horizontal fluid or gas wells, comprising:

a horizontal well having a production openhole;
at least one blocker inside the production openhole for dividing the production openhole into individual compartments; and
at least two individual production strings, of which at least one extending inside the production openhole, from the surface to one of the compartments with at least one production string individually for each compartment;
wherein each individual production string is connected to a choke, for individually controlling a production flow rate of fluid or gas for each compartment; and
wherein each of the production strings includes at least one flow control device which adjusts the flow rate according to an estimated volume of fluid or gas in a formation, or formations, adjacent to the respective compartment such that water coning is managed or avoided.

7. The production device according to claim 6, wherein each blocker is impermeable for the fluid or gas and can be positioned freely along the length of the production openhole or casing.

8. The production device according to claim 7, wherein the individual production strings extend through the respective blocker or blockers and the respective blocker seals the pass of each production string against the fluid or gas.

9. The production device according to claim 6, wherein each individual production string can also be used as an injection string for injecting an injection liquid or gas from the surface to the corresponding compartment.

10. The production device according to claim 6, wherein the production openhole further comprises a permeable outer shell to allow the fluid or gas to penetrate from a formation, or formations, into the production openhole, wherein the outer shell is made of a metal tube and a cement layer, which have a porous structure.

11. The production device according to claim 6, wherein the production strings are made of a flexible and durable material, allowing to be bent from the vertical well to the horizontal production openhole and to endure high pressures of the fluid, gas and/or injection liquid, gas piped through.

12. The production device according to claim 6, wherein said compartments include at least one flow control device.

13. The production device according to claim 6, wherein said string includes at least one sensor.

14. The production device according to claim 6, wherein said string includes a downhole processor.

15. The production device according to claim 6, wherein said string includes a communication device for communicating with a remote location.

* * * * *